US008084890B2

(12) United States Patent
Lie

(10) Patent No.: US 8,084,890 B2
(45) Date of Patent: Dec. 27, 2011

(54) APPARATUS AND METHOD FOR FIRE PROTECTION OF ELECTRICAL INSTALLATIONS

(76) Inventor: Per Erik Lie, Kolbotn (NO)

( * ) Notice: Subject to any disclaimer, the term of this patent is extended or adjusted under 35 U.S.C. 154(b) by 413 days.

(21) Appl. No.: 12/444,855

(22) PCT Filed: Oct. 8, 2007

(86) PCT No.: PCT/NO2007/000353

§ 371 (c)(1),
(2), (4) Date: Apr. 9, 2009

(87) PCT Pub. No.: WO2008/044939

PCT Pub. Date: Apr. 17, 2008

(65) Prior Publication Data

US 2010/0073841 A1 Mar. 25, 2010

(30) Foreign Application Priority Data

Oct. 9, 2006 (NO) ..... 20064585

(51) Int. Cl.

| | |
|---|---|
| ***H01H 37/00*** | (2006.01) |
| ***H01H 83/00*** | (2006.01) |
| ***G08B 17/00*** | (2006.01) |
| ***G08B 17/06*** | (2006.01) |
| ***G08B 17/10*** | (2006.01) |

(52) U.S. Cl. ..... 307/117; 307/116; 340/628; 340/632

(58) Field of Classification Search ..... 307/116, 307/117; 340/628, 632

See application file for complete search history.

(56) References Cited

U.S. PATENT DOCUMENTS

| | | | | |
|---|---|---|---|---|
| 3,714,456 | A * | 1/1973 | Krohmer et al. | 307/117 |
| 5,936,531 | A * | 8/1999 | Powers | 340/628 |
| 6,046,441 | A * | 4/2000 | Daffron | 219/506 |
| 6,747,459 | B2 * | 6/2004 | Parker et al. | 324/536 |
| 6,801,132 | B2 | 10/2004 | Clauss et al. | |
| 6,813,129 | B2 * | 11/2004 | Burdick | 361/104 |
| 6,876,533 | B1 * | 4/2005 | Ryan | 361/104 |
| 7,187,529 | B2 * | 3/2007 | Natili et al. | 361/103 |

(Continued)

FOREIGN PATENT DOCUMENTS

| | | |
|---|---|---|
| EP | 0 962 903 | 12/1999 |

(Continued)

OTHER PUBLICATIONS

International Search Report dated Feb. 1, 2008, from corresponding PCT application.

European Search Report in Corresponding Application No. EP 07834766 dated Aug. 23, 2010.

*Primary Examiner* — Jared Fureman
*Assistant Examiner* — Adi Amrany
(74) *Attorney, Agent, or Firm* — Young & Thompson

(57) ABSTRACT

A system for detecting and preventing electrical fire includes an intake fuse box, a main distribution panel/housing, a sub-distribution panel/housing, a main power circuit (MPC) connecting the intake fuse box (IFB) to the main distribution panel (MDP), and a sub power circuit (SPC) connecting the MDP to the subdistribution panel. First-third gas/smoke/heat detectors are arranged in the IFB, main panel housing, and subpanel housing, respectively, and provide respective low level outputs for gas/smoke/heat exceeding a first threshold and high level outputs for a second threshold. A remote controlled main level circuit breaker is arranged in the MPC, a remote controlled sub level circuit breaker is arranged in the SPC, and a controller unit has first-third inputs connected to first-third gas/smoke/heat detectors, respectively, for receiving first-third low and high level outputs, an alarm output, and first and second breaker control outputs connected to respective main and sub level circuit breakers.

4 Claims, 4 Drawing Sheets

U.S. PATENT DOCUMENTS

| | | | | |
|---|---|---|---|---|
| 7,231,988 | B2 * | 6/2007 | Jerg et al. | 169/60 |
| 7,869,167 | B2 * | 1/2011 | Wakchaure | 361/36 |
| 7,872,379 | B2 * | 1/2011 | Fuller et al. | 307/326 |
| 2004/0140191 | A1 | 7/2004 | Jerg et al. | |
| 2005/0093707 | A1 | 5/2005 | Van Winkle et al. | |
| 2005/0110645 | A1 * | 5/2005 | Boyden | 340/584 |
| 2005/0201030 | A1 * | 9/2005 | Toth | 361/91.1 |
| 2006/0006997 | A1 | 1/2006 | Rose-Pehrsson et al. | |
| 2008/0012681 | A1 * | 1/2008 | Kadar et al. | 337/298 |

FOREIGN PATENT DOCUMENTS

| | | |
|---|---|---|
| FR | 2 543 839 | 10/1984 |
| GB | 2 287 191 | 9/1995 |
| WO | 03/002208 | 1/2003 |

* cited by examiner

APPARATUS AND METHOD FOR FIRE PROTECTION OF ELECTRICAL INSTALLATIONS

GENERAL INTRODUCTION

The invention relates to apparatus, systems and methods whose specific purpose is to prevent fires in the fuse box (including subdistributions and intake boxes) of an electrical installation, and for use in other risk areas of the installation that may constitute a danger of an incipient fire having an electrical cause (e.g., washrooms, kitchens, engine rooms, pumps rooms, technical rooms, etc.). More specifically, a system according to the invention is based on a central unit, and can communicate with or be connected to external warning systems (for example, alarm systems and number transmitters).

PRIOR ART

U.S. Pat. No. 7,187,529 describes technology for detecting a gas associated with a glowing contact, and for interrupting a power circuit.

WO 03/002208 relates to a fire protection device for domestic appliances, which device comprises a fault current circuit breaker and a gas sensor with a gas sensor circuit.

FR 2 543 839 describes a device comprising a differential circuit breaker connected to a circuit comprising a sensor which is sensitive to gas liberated during an incipient fire in an electric circuit, and which can cut off power supply to an electrical system.

However, the known solutions cannot be used directly in large electrical installations.

One of the objects of the present invention is to provide protection of an electrical distribution installation against fire or against the consequences of fire.

BRIEF DESCRIPTION OF THE INVENTION

The aforementioned object is achieved by means of a technical solution that is characterised by the features set forth in the attached patent claims.

DETAILED DESCRIPTION OF THE INVENTION

Figure 1:
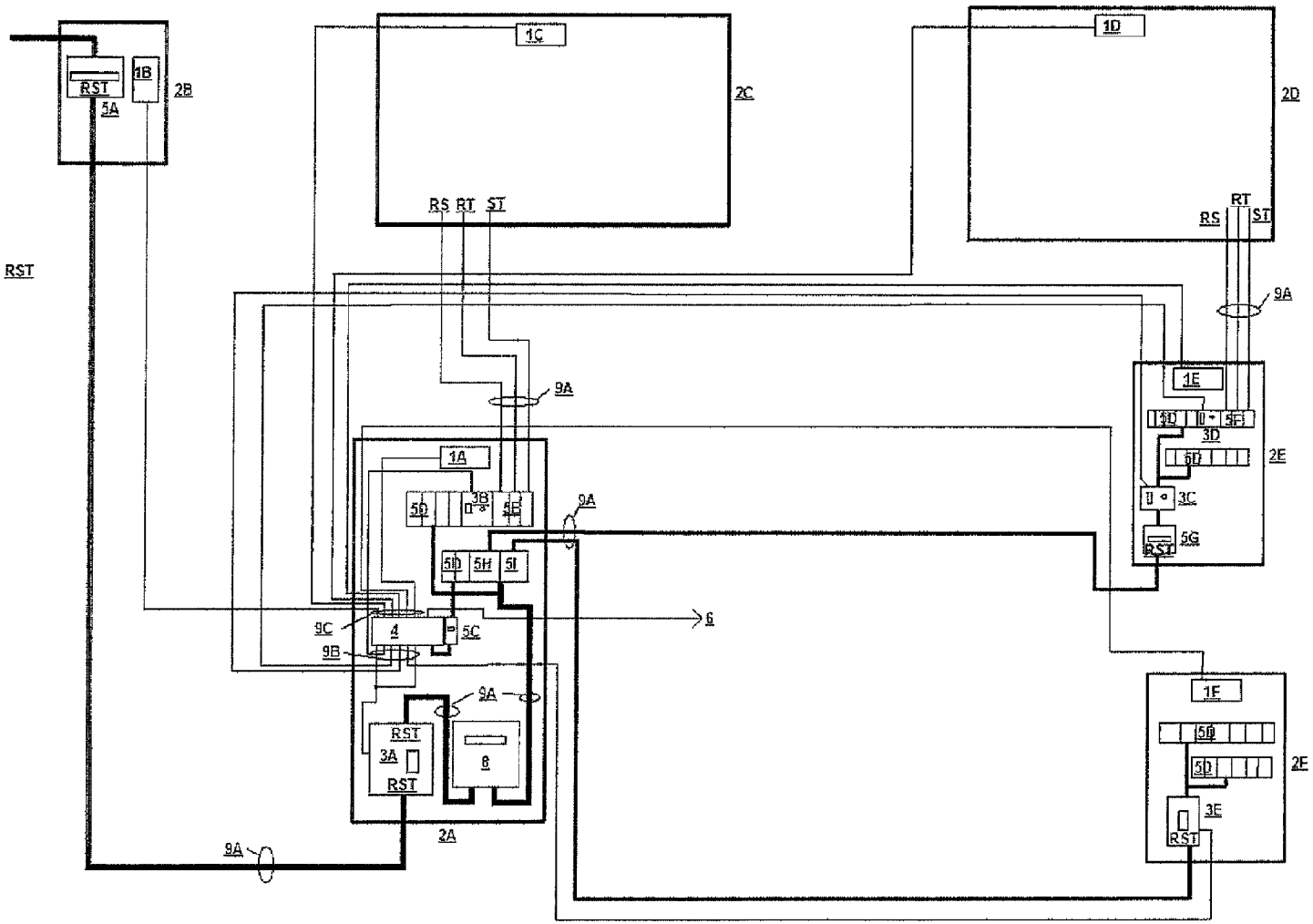
FIG. 1 is an electrical circuit schematic drawing illustrating a first example of an electrical installation including an EFP system according to the invention in an agricultural building.
Figure 2:
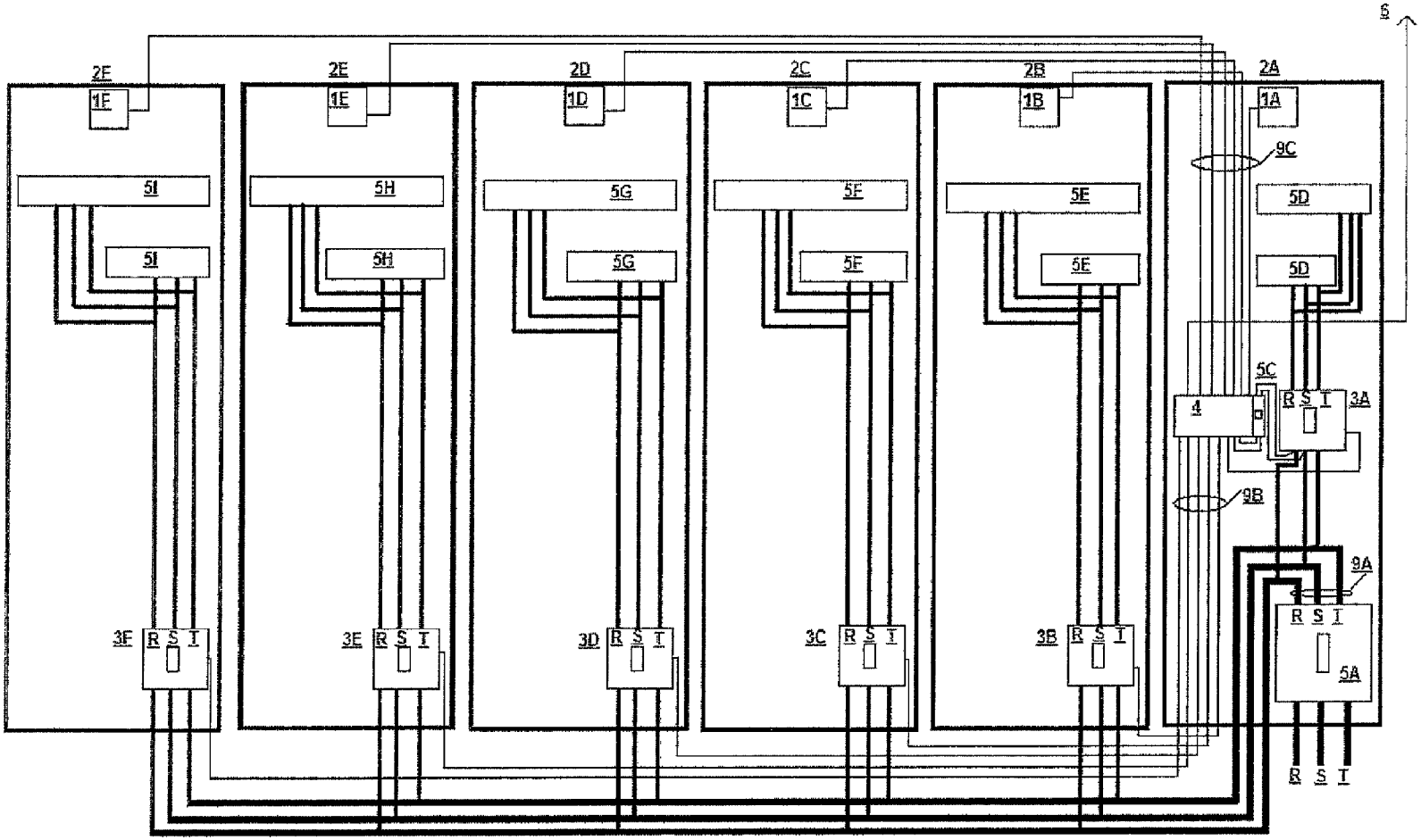
FIG. 2 is an electrical circuit schematic drawing illustrating a second example of an electrical installation including an EFP system according to the invention in an industrial plant.
Figure 3:
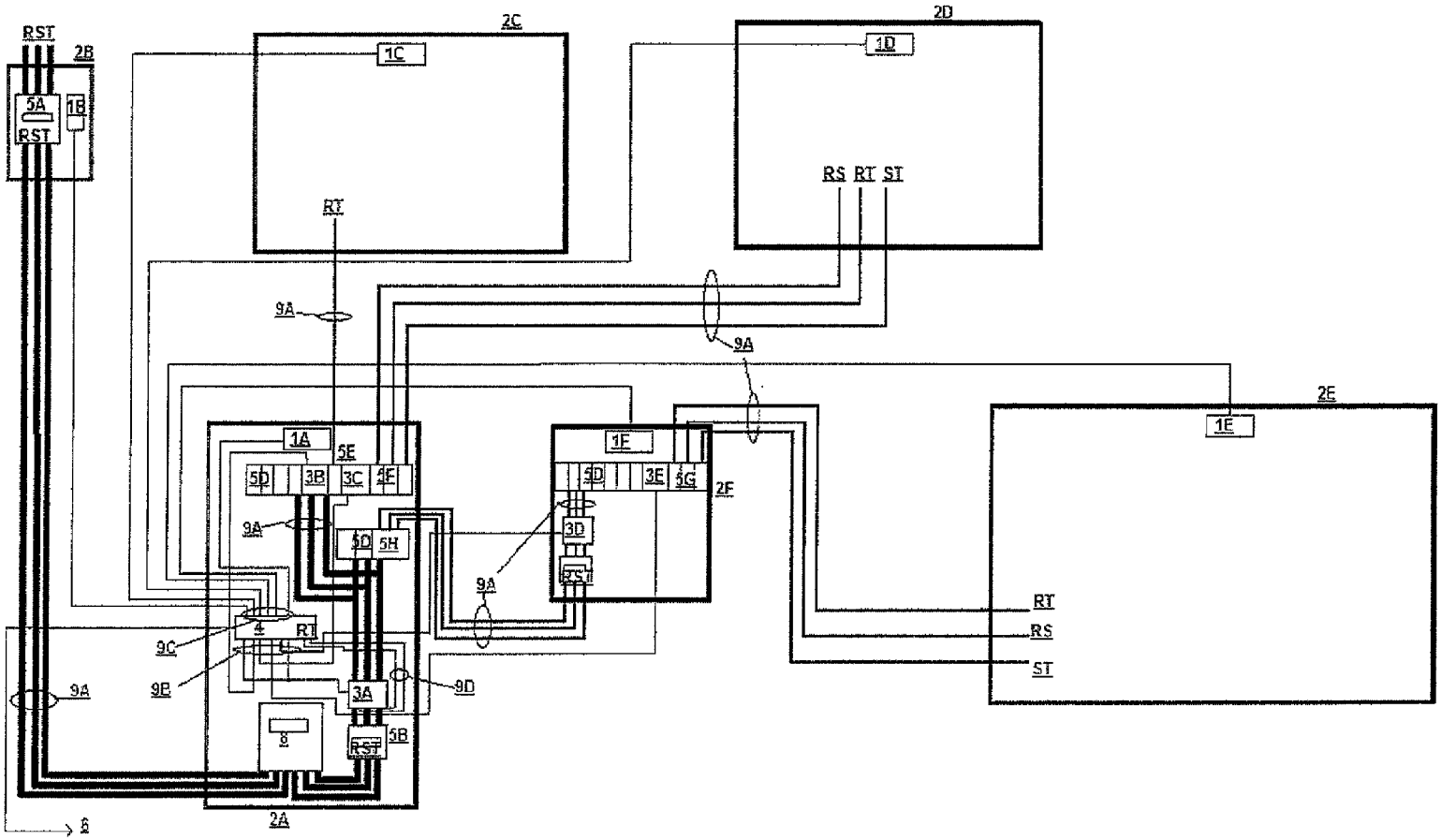
FIG. 3 is an electrical circuit schematic drawing illustrating a third example of an electrical installation including an EFP system according to the invention in a dwelling.
Figure 4:
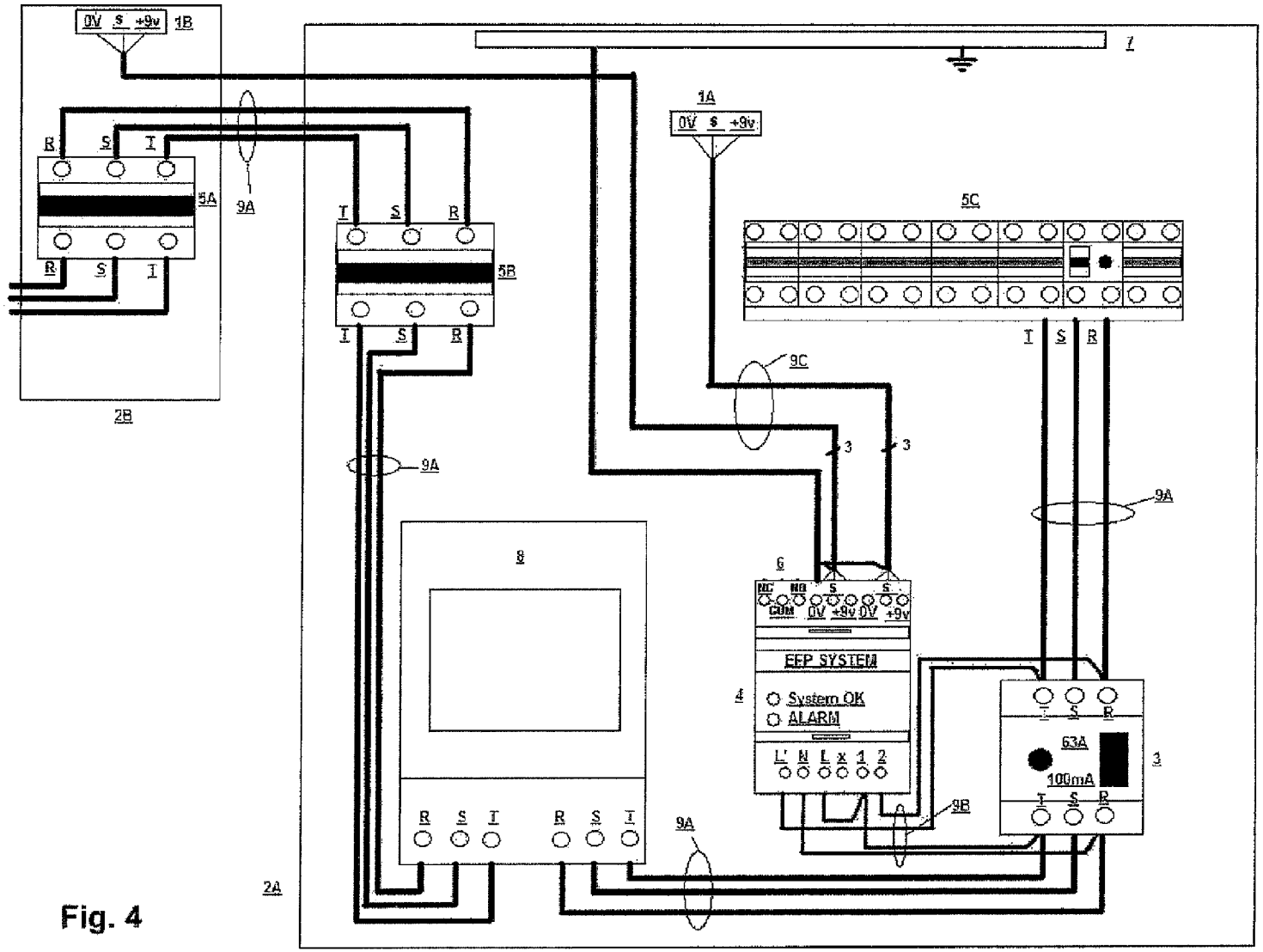
FIG. 4 is an electrical wiring diagram illustrating an example of an electrical intake and main distribution installation adapted for an EFP system according to the invention.

The invention is described below both by means of a general indication of the technical elements of its structure and functionality, and by means of more detailed descriptions of advantageous embodiments.

In the following description, the abbreviation EFP is generally used for the term "electrical installation fire protection".

Components that an Advantageous Embodiment of the EFP System Will Consist of:

1. Detectors
2. Central unit
3. Switching devices

General Functional Description:

1. Detectors:
   - Detectors placed in fuse boxes and/or risk areas will detect gas/smoke/heat that is released from equipment and cables when overheating/incipient fire occurs as a result of electrical arcing, overloading and/or short circuiting.
   - When the detectors detect an incipient fire, they will give a signal to the central unit.
2. Central unit:
   - When the central unit receives a signal from detectors, it will go into alarm mode.
   - When the central unit goes into alarm mode, it will do two things:
     - Activate a relevant switching device in the system.
     - Give a signal to external warning systems if connected (for example, other alarm systems, number transmitters and/or acoustic/visual alarms).
3. Switching devices:
   - When a switching device is activated by the central unit, it will break the current supply to the fault location in question and thus stop the incipient fire.

Description of Components and Different Component Variants:

1. Detectors:
   - 1.1. General description: The detectors used may be of various types depending on where they are to be placed, what they are to detect, how they are to warn the central unit, and so forth. The detectors can be placed in fuse boxes, risk areas and in electrical equipment/appliances that may be at risk of fire with an electrical cause. The detectors are so positioned that they detect, as quickly as possible, gas/smoke/heat generation. The detectors may be both spot detectors (conventional detectors) and line detectors (heat-detecting cable).
   - 1.2. Component variants:
     - 1.2.1. Detection variants
       - 1.2.1.1. Ionic detector
         - 1.2.1.1.1. Ionic detector with normal radioactive source (>30 kBq).
         - 1.2.1.1.2. Environment-friendly detector with about 3.5 kBq radioactive source (up to 90% reduction compared to most other ionic detectors).
       - 1.2.1.2. Optical detector
       - 1.2.1.3. Thermal detector
       - 1.2.1.4. Combination detectors (combine ionic, optical and/or thermal detection).
       - 1.2.1.5. Other type of gas detector
     - 1.2.2. With or without pre-warning
       - 1.2.2.1. Detector without pre-warning: Gives a signal to the central unit on detection of a certain amount of gas/smoke/heat.
       - 1.2.2.2. Detector with pre-warning: Can give two different signals to the central unit, a pre-warning signal in the event of a certain amount of gas/smoke/heat, and an ordinary alarm signal in the event of larger amounts of gas/smoke/heat.
     - 1.2.3. With or without EMC protection
       - 1.2.3.1. Detector without EMC protection: No special protection against electric noise/magnetic fields.
       - 1.2.3.2. Detector with EMC protection: EMC protection against electric noise/magnetic fields.

1.2.4. With or without cable
1.2.4.1. Detector connected to central unit by cable
1.2.4.2. Detector wirelessly connected to central unit.
1.2.5. Power Supply Variants
1.2.5.1. Detector that receives power supply from central unit.
1.2.5.2. Detector that receives power supply from batteries.
1.2.5.3. Detector that receives power supply from central unit with batteries as back-up.

2. Central Unit:
2.1. General description: The central unit is the hub of the system and has several functions:
Provides power to the detectors.
Receives wire-based signals (pre-warning signals and alarm signals) from the detectors (on detection of gas/heat/smoke).
Receives wireless signals (pre-warning signals and alarm signals) from the detectors (on detection of gas/heat/smoke).
Sends pre-warning signal and alarm signal to external warning systems (when it receives signals from detector).
Activates relevant switching device so that the switching device cuts the current to the fault location (when the central unit receives alarm signals from detector).
The central unit can be mounted both inside and outside the fuse box.
The central unit can be mounted as a free-standing unit or can be integrated into the switching device.
2.2. Component variants:
2.2.1. Single-zone or multizone central unit:
2.2.1.1. The single-zone central unit may have one or more detectors and one or more switching devices connected thereto. When the single-zone central unit goes into alarm mode (receives alarm signal from one or more detectors), an alarm signal is sent to an external warning system and all switching devices connected to the central unit are activated and break the current to is the circuits to which they are connected.
2.2.1.2. The multizone central unit may have a plurality of detectors and a plurality of switching devices connected thereto. With the multizone central unit, it is possible to divide the electrical installation up into several zones that are connected to specific detectors and switching devices (one or more detectors and switching devices per zone). If one or more detectors associated with a particular zone send an alarm signal to the central unit, the central unit will activate the switching device or devices that are associated with the zone in question, whilst other zones will still have power. The central unit will also give an alarm signal to an external warning system that indicates which zone has been cut off. The multizone central unit may either be in one module with several zones or module-based for construction of 1-n zones (one zone per module).
2.2.2. With or without pre-warning
2.2.2.1. Central unit without pre-warning: When the central unit receives a signal from a detector, it sends an alarm signal to an external warning system and at the same time activates the switching device which breaks the current immediately.
2.2.2.2. Central unit with pre-warning (must be connected to a detector with pre-warning): When the central unit receives a pre-warning signal from a detector, it sends a pre-warning signal to an external warning system without activating the switching device. This gives the owner/user of the installation the opportunity to inspect the fault location and repair the fault before the current is broken, or, for example, to be able to carry out a controlled run down of sensitive equipment before current is broken. When the central unit receives a normal alarm signal from a detector, it sends an alarm signal to an external warning system and at the same time activates the switching device that breaks the current immediately.
2.2.3. Power supply variants
2.2.3.1. A central unit that receives power supply from the electric installation (mains-based power supply).
2.2.3.2. A central unit that receives power supply from batteries.
2.2.3.3. A central unit that receives power supply from the electrical installation with batteries as back-up.

3. Switching Devices:
3.1. General description: The task of the switch is to cut the current to the installation (or the zone of the installation to which the switch is connected) when it has been activated by the central unit. After the switch has cut the current, the current can be turned on again manually by activating the switch (manual cut-in). The switch is located expediently in relation to the circuit or circuits it is to break in the installation.
3.2. Different Component Variants
3.2.1. Earth fault breaker—different amperes adapted to the installation
3.2.1.1. Standard earth fault breaker without time delay
3.2.1.2. Earth fault breaker with time delay (G characteristic)
3.2.2. Contactor—switching device which has controlled cut-in and cut-off
3.2.3. Circuit breaker with zero voltage coil
3.2.4. Specially developed switching device with controlled cut-off and manual cut-in.
3.2.5. Other types of switching devices Detailed Description with Explanations of the EFP System (One Zone)

Has a system that prevents incipient fires in fuse boxes resulting from faults, overloading or electrical arcing in an electrical installation.

The system consists of a central unit, detectors and a switching device.

The system is mounted in the installation's fuse boxes in the following way:
The EFP central unit is mounted in the installation's main fuse box at a suitable point (where there is space)
Detectors are mounted in all the fuse boxes of the installation (intake box, main box and subdistributions).
The switching device that is to break the current to the electrical installation is mounted on the installation's supply cable between the main fuse and the installation's circuit fuses.

Cable between the central unit and detectors must be of a shielded type (e.g., PTS, FTP).

As connection between the central unit and the switching device, there is used, for example, PN, RK 2.5 mm2 short circuit-proof type/lay.

It is regarded as important that connections between switching device/earth fault breaker and EFP central unit should be installed using short circuit-proof type (with approved fibreglass sleeving) because the connections can be protected by as much as 63 A from the main fuse, which is higher than the current-carrying capacity of the connections.

Sequence of Events with Reference to the Circuit Diagram FDEC-C (Appendix 5) and Wiring Diagram (Appendix 4), Single-Zone System Explanation of Symbols—Appendix 4

| Marking | Explanation |
|---|---|
| 1A-B | Detectors |
| 2A-B | Fuse box and intake box |
| 3 | Switching device |
| 4 | EFP central unit |
| 5A-C | Fuses |
| 6 | Potential-free alarm output |
| 7 | Busbar for earthing |
| 8 | Kilowatt hour meter |
| 9A-C | Cable types |

The EFP central unit receives voltage from the primary side (T and R) of the switching device (3A) in order to provide operating voltage to the central unit when the switching device is tripped. Input voltage is supplied to the EFP central unit (4) via terminals, marked N and L, of the central unit's transformer (TR1). The transformer reduces the mains voltage down to the operating voltage of the system. The operating voltage is then rectified (DF06M) from AC to DC voltage as the system is dependent on DC voltage. The transformer supplies the EFP central unit's outgoing detector terminals (+9V and 0V) with a constant operating voltage (via a voltage stabiliser which is to provide a constant operating voltage to the detectors as mains voltage may vary in the course of 24 hours). The detectors will receive their operating voltage and be able to communicate with the EFP central unit via cable.

When a detector detects such a high concentration of gases due to an incipient fire that the detectors go into alarm mode, a +9V signal will be sent back to the EFP central unit via the detector's alarm output (S) to the EFP central unit's communication input (S) which will trip relay (RE2). When relay (RE2) has tripped, the contact in the relay will form a connection between the EFP central unit's relay terminals (1 and 2). When the system goes into alarm mode, the switching device (3A) will trip and break the supply current to the circuit fuses (5C) in the installation. The switching device (3A) is tripped in that a connection is made from T-phase on the primary side of the switching device (earth fault breaker) (3A) to the EFP central unit's (4) relay input (1) through a resistor (R4) via relay (RE2) through PTC to the EFP central unit's relay output (2) and then to the R-phase on the secondary side of the switching device (earth fault breaker)(3A). The function of the tripping is that a simulated earth fault is created by means of resistor R4 that limits the leakage current between the T (primary) and R (secondary) phases to about 100 mA, which the earth fault breaker will perceive as an earth fault which will trip the breaker (this function is like the test function of the earth fault breaker).

The PTC component's function is a safety measure in the circuit which will break the connection if the resistor R4 becomes too warm.

PTC stands for Positive Temperature Coefficient and is a temperature variable resistor which has higher resistance on temperature increase. In advantageous embodiments of the invention, a PTC is preferably used with outputs as indicated for the product, model designation C890, as described in the data magazine labelled 10/02, published by EPCOS AG Corporate Communications, PO Box 80 17 09, 81617 Munich, GERMANY.

The function is explained below:

The relay contact RE2 to the resistor R4 and PTC represents a path for "leakage current", where this circuit is closed by RE2 only in the ALARM state, and the current causes a breaking effect of the earth current leakage breaker. This current is limited by the resistor R4, which in the example is 1k5 ohm and the resistor Rn of the PTC resistor (just 150 ohm).

The duration of this current is determined by a reaction time of the earth current leakage breaker, and is typically quite short, as for example about 10 ms.

In the event of a malfunction in the earth current leakage breaker or a faulty wiring of the circuit in the installation, the resistor R4 will not be able to work with a constant current of about 150 mA at a voltage of 230V, in which case the current will be limited by the PTC resistor to avoid an overloading of the resistor R4.

In the illustrated example, the resistor R4 is dimensioned only for 2 W continuous power.

When the switching device (3A) has been tripped, a relay (RE1) which receives its power supply between terminals N and L' (R phase on the secondary side of the earth fault breaker) will lose the control current it has to put out. The working contact in relay (RE4) opens and makes a connection between the 0V point of the rectifier and the cathode of a red LED (D4), which will light up the diode indicating that one of the detectors has gone into alarm mode.

The make-break contact of relay RE1 controls the central unit's potential-free alarm output (6).

The scenario of the switching device (earth fault breaker) (3A) being tripped by an earth fault will not light up Red ALARM LED (D4). The LED anode voltage is controlled from the detectors' (1A and 1B) alarm output (S) via the EFP central unit's communication input (S) which only is voltage carrying when a detector has gone into alarm mode.

Resistor (R1) and varistor (VA1) constitute overvoltage protection which is to protect the central unit against overvoltage which may enter via the central unit's power supply as a consequence of faults on the power grid or external atmospheric effects that may have an adverse effect on the central unit.

The shield/earthing in cable between the EFP central unit and detectors is connected to a terminal for 0V in the EFP central unit's detector output in order to prevent accidental alarms because of the effect of EMC from other electrical equipment.

EXAMPLES OF DIFFERENT EFP SYSTEMS WITH REFERENCE TO DRAWINGS

EXAMPLE 1

In the explanation reference is made to Example Drawing 1, Appendix 1.

Explanation of Symbols—Appendix 1:

| Marking | Explanation |
|---|---|
| 1A-F | Detectors |
| 2A-F | Fuse boxes and risk rooms |
| 3A-E | Switching devices |
| 4 | EFP central unit |

-continued

| Marking | Explanation |
|---|---|
| 5A-I | Fuses |
| 6 | Potential-free alarm output |
| 7 | Busbar for earthing |
| 8 | Kilowatt hour meter |
| 9A-C | Cable types |

The electrical installation in the example drawing is from an agricultural outbuilding. The installation has four fuse boxes: one intake box, a main distribution, subdistribution 1 and subdistribution 2. The main distribution (2A) of the installation receives input voltage from intake fuse (5A), subdistribution 1 (2E) receives its input voltage from the main distribution via circuit fuse (5H), and subdistribution 2 (2F) receives its input voltage from the main distribution via circuit fuse (5I). There are also two risk rooms that are to be protected from fire with an electrical cause. Risk room (2C) receives voltage from fuses (5E) in the main distribution (2A) whilst risk room (2D) receives voltage from fuses (5F) in subdistribution 1 (2E).

Low-current cable (9C) between the central unit and detectors must be of a shielded type (e.g., PTS, FTP).

Cable (9A) between fuses in the distribution box and between the distribution box and risk rooms is of the high-voltage type.

Cable (9B) between the EFP central unit and the switching devices is of the high voltage/signal type.

As a connection between the central unit and the switching device there is used, for example, PN, RK 2.5 mm2 short circuit-proof type/lay.

The EFP central unit (4) is mounted in the main fuse box (2A). The central unit has mains-based power supply through control current fuse (5C) to protect the central unit from unduly large short-circuiting currents in the event of faults. The central unit also has back-up battery operation that ensures continued operation in the event of a power failure. The central unit has a function for pre-warning of an incipient fire.

The central unit in the example is module-based with six zones that are made up as follows:

- Zone 1: Intake box (2B) (detector (1B) and switching device (3A))
- Zone 2: Risk room (2C) (detector (1C) and switching device (3B))
- Zone 3: Risk room (2D) (detector (1D) and switching device (3D))
- Zone 4: Subdistribution 1 (2E) (detector (1E) and switching device (3C))
- Zone 5: Subdistribution 2 (2F) (detector (1F) and switching device (3E))
- Zone 6 Main distribution (2A) (detector (1A) and switching device (3A).

Detectors (1A-F) are mounted in all fuse boxes (2A, 2B, 2E and 2F) and in risk rooms (2C and 2D). The detectors in the example detect both changes in ionic current and heat (combination detectors that detect gas, smoke and heat). Furthermore, they have the function of pre-warning in the event of an incipient fire. The detectors receive power supply from the central unit.

Switching devices (3A-E) are mounted in the respective fuse boxes that supply the parts of the installation that are to be monitored by the detectors.

In the event of an incipient fire in the intake fuse (5A), detector (1B) located in the intake box will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3A). The switching device then breaks the current to the whole installation in order to isolate the fault location before fire develops.

In the event of an incipient fire in electrical equipment in risk room (2C), detector (1C) will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3B). The switching device then breaks the current to the circuit fuses (5E) of the risk room. The rest of the installation is in operation.

In the event of an incipient fire in electrical equipment in risk room (2D), detector (1D) will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3D). The switching device thus breaks the current to the circuit fuses (5F) of the risk room. The rest of the installation is in operation.

In the event of an incipient fire in subdistribution 1 (2E), detector (1E) will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3C). The switching device then breaks the current supply to the whole of subdistribution 1 (2E). The rest of the installation is in operation.

In the event of an incipient fire in subdistribution 2 (2F), detector (1F) will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3E). The switching device then breaks the current to the whole of subdistribution 2 (2F). The rest of the installation is in operation.

In the event of an incipient fire in the main distribution (2A), detector (1A) will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3A). The switching device then interrupts power to the whole plant in order to isolate the fault location before fire develops.

When the EFP system has shut down a fuse box, an electrician or operation manager can turn on power in the fuse box in question and wait for about 10 minutes so that the temperature at the fault location rises again. He can subsequently take a thermal image of the fuse box to find the fault location. The fault location can then be repaired quickly with a brief shutdown as none of the equipment has been destroyed as a consequence of the incipient fire (for example, chlorine gas contamination).

EXAMPLE 2

In this explanation reference is made to Example Drawing 2, Appendix 2

Explanation of Symbols—Appendix 2:

| Marking | Explanation |
|---|---|
| 1A-F | Detectors |
| 2A-F | Fuse boxes and risk rooms |
| 3A-E | Switching devices |
| 4 | EFP central unit |
| 5A-I | Fuses |
| 6 | Potential-free alarm output |
| 7 | Busbar for earthing |
| 8 | Kilowatt hour meter |
| 9A-C | Cable types |

The electrical installation in the example drawing is from an industrial plant. It has six fuse boxes that are to be protected from fire with an electrical cause, resulting from electrical arcing and/or overloading.

The EFP central unit (4) is mounted in fuse box 6(2A) as it is there the main cable enters. The central unit has mains-based power supply through a control current fuse (5C) to protect the central unit from large short-circuiting currents in the event of a fault. The central unit also has back-up battery operation that ensures continued operation in the event of a power failure. The central unit has a function for pre-warning of an incipient fire.

Low current cable (9C) between the central unit and detectors must be of the shielded type (e.g., PTS, FTP).

Cable (9A) between fuses in the distribution box and between the distribution box and risk areas is of the high voltage type.

Cable (9B) between the EFP central unit and the switching devices is of the high voltage/signal type.

The central unit in the example is module-based with six zones that are made up as follows:

- Zone 1: Fuse box 1 (2F), detector (1F) and switching device (3F)
- Zone 2: Fuse box 2 (2E), detector (1E) and switching device (3E))
- Zone 3: Fuse box 3 (2D), detector (1D) and switching device (3D)
- Zone 4: Fuse box 4 (2C), detector (1C) and switching device (3C)
- Zone 5: Fuse box 5 (2B), detector (1B) and switching device (3B)
- Zone 6 Fuse box 6 (2A), detector (1A) and switching device (3A)

Detectors (1A-F) are mounted in all fuse boxes (2A-F). The detectors in the example are ionic and detect gas and smoke. Furthermore, they have the function of pre-warning in the event of an incipient fire. The detectors receive power supply from the central unit (4).

Switching devices (3A-F) are mounted in each fuse box connected to the circuit fuses of the fuse boxes.

In the event of an incipient fire in fuse box 1 (2F), detector (1F) will detect gas/smoke that is generated and give a pre-warning signal to the central unit (4) when the concentration of gas/smoke exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke exceeds a pre-set alarm level (higher than the pre-warning level), the detector will give an alarm signal to the central unit. The central unit will then both give an alarm signal to an external warning system via the central unit's alarm output (6) and activate switching device (3F) which breaks current to the circuit fuses (5I) in fuse box 1 (2F). The rest of the installation is in operation.

In the event of an incipient fire in fuse box 2 (2E), detector (1E) will detect gas/smoke that is generated and give a pre-warning signal to the central unit (4) when the concentration of gas/smoke exceeds a preset warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/ smoke exceeds a pre-set alarm level (higher than the pre-warning level), the detector will give an alarm signal to the central unit. The central unit will then both give an alarm signal to an external warning system via the central unit's alarm output (6) and activate switching device (3E) which breaks the current to the circuit fuses (5H) in fuse box 2 (2E). The rest of the installation is in operation.

In the event of an incipient fire in fuse box 3 (2D), detector (1D) will detect gas/smoke that is generated and give a pre-warning signal to the central unit (4) when the concentration of gas/smoke exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke exceeds a pre-set alarm level (higher than the pre-warning level), the detector will give an alarm signal to the central unit. The central unit will then both give an alarm signal to an external warning system via the central unit's alarm output (6) and activate switching device (3D) which breaks the current to the circuit fuses (5G) in the fuse box 3 (2D). The rest of the installation is in operation.

In the event of an incipient fire in fuse box 4 (2C), detector (1C) will detect gas/smoke that is generated and give a pre-warning signal to the central unit (4) when the concentration of gas/smoke exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke exceeds a pre-set alarm level (higher than the pre-warning level), the detector will give an alarm signal to the central unit. The central unit will then both give an alarm signal to an external warning system via the central unit's alarm output (6) and activate switching device (3C) which breaks the current supply to the circuit fuses (5F) in fuse box 4 (2C). The rest of the installation is in operation.

In the event of an incipient fire in fuse box 5 (2B), detector (1B) will detect gas/smoke that is generated and give a pre-warning signal to the central unit (4) when the concentration of gas/smoke exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke exceeds a pre-set alarm level (higher than the pre-warning level), the detector will give an alarm signal to the central unit. The central unit will then both give an alarm signal to an external warning system via the central unit's alarm output (6) and activate switching device (3B) which breaks the current to the circuit fuses (5E) in fuse box 5 (2B). The rest of the installation is in operation.

In the event of an incipient fire in fuse box 6 (2A), detector (1A) will detect gas/smoke that is generated and give a pre-warning signal to the central unit (4) when the concentration of gas/smoke exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke exceeds a pre-set alarm level (higher than the pre-warning level), the detector will give an alarm signal to the central unit. The central unit will then both give an alarm signal to an external warning system via the central unit's alarm output (6) and activate switching device (3A) which interrupts power to the circuit fuses (5D) in fuse box (2A). The rest of the installation is in operation.

When the EFP system has shut down a fuse box, an electrician or operation manager can turn on power in the fuse box in question and wait for about 10 minutes so that the temperature at the fault location rise again. He can subsequently take a thermal image of the fuse box to find the fault location. The fault location can then be repaired quickly with a brief shutdown as none of the equipment has been destroyed as a consequence of the incipient fire (for example, chlorine gas contamination).

EXAMPLE 3

In this explanation reference is made to Example Drawing 3, Appendix 3

Explanation of Symbols—Appendix 3:

| Marking | Explanation |
|---|---|
| 1A-F | Detectors |
| 2A-F | Fuse boxes and risk rooms |
| 3A-E | Switching devices |
| 4 | EFP central unit |
| 5A-F | Fuses |
| 6 | Potential-free alarm output |
| 7 | Busbar for earthing |
| 8 | Kilowatt hour meter |
| 9A-D | Cable types |

The electrical installation in the exemplary drawing is from a dwelling. It has three fuse boxes: one intake box (2B), a main distribution (2A) and one subdistribution (2F).

There are also three risk rooms (2C-E) that are to be protected from fire with an electrical cause. The main distribution (2A) of the installation receives input voltage from intake fuse (5A) whilst subdistribution (2F) receives its input voltage from the main distribution via circuit fuse (5H). There are also three risk rooms (2C-E) that are to be protected from fire with an electrical cause. Risk room (2C) receives voltage from fuse (5E) in main distribution (2A), risk room (2D) receives voltage from fuses (5F) in main distribution (2A) and risk room (2E) receives voltage from fuses (5G) in subdistribution (2F).

Low current cable (9C) between the central unit and detectors must be of the shielded type (e.g., PTS, FTP)

Cable (9A) between fuses in the distribution box and between the distribution box and risk rooms is of the high voltage type.

Cable (9B) between the EFP central unit and the switching devices is of the high voltage/signal type.

As connection between central unit and switching device there is used, for example, PN, RK 2.5 mm2 short circuit-proof type/lay.

NB: It is important that connections (9D) between the switching device/earth fault breaker and the EFP central unit are installed using short circuit-proof type (with approved fibreglass sleeving) because the connections can be protected by as much as 63 A from the main fuse, which is higher than the current-carrying capacity of the connections.

The central unit (4) is mounted in the main fuse box (2A). The central unit has mains-based power supply. The central unit also has back-up battery operation which ensures continued operation in the event of a power failure. The central unit has a function for pre-warning of an incipient fire.

The central unit in the example is module-based with six zones that are made up as follows:

Zone 1: Intake box (2B) (detector (1B) and switching device (3A))

Zone 2: Risk room (2C) (detector (1C) and switching device (3B))

Zone 3: Risk room (2D) (detector (1D) and switching device (3C))

Zone 4: Risk room (2E) (detector (1E) and switching device (3F))

Zone 5: Subdistribution (2F) (detector (1F) and switching device (3D))

Zone 6 Main distribution (2A) (detector (1A) and switching device (3A))

Detectors (1A-F) are mounted in all fuse boxes (1A, 1B and 1F) and in risk rooms (2C-E). The detectors in the example detect both changes in ionic current and heat (combination detectors that detect gas, smoke and heat). Furthermore, they have the function of pre-warning in the event of an incipient fire. The detectors receive power supply from the central unit.

Switching devices (3A-F) are mounted in the respective fuse boxes that supply the parts of the installation that are to be monitored by the detectors.

In the event of an incipient fire in intake fuse (5A), detector (1B) located in the intake box (2B) will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3A). The switching device then breaks the current to the whole installation in order to isolate the fault location before the fire develops.

In the event of an incipient fire in risk room/living room (2C), detector (1C) located in the living room will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3B). The switching device then breaks the current to the living room circuit (5E) in order to isolate the fault location before the fire develops.

In the event of an incipient fire in risk room/kitchen (2D), detector (1D) located in the kitchen will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3C). The switching device then breaks the current to the circuits (5F) that go to the kitchen (2D) in order to isolate the fault location before the fire develops.

In the event of an incipient fire in risk room/washroom (2E), detector (1E) located in the washroom will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3F). The switching device then breaks the current to the circuits (5G) that go to the washroom (2E) in order to isolate the fault location before the fire develops.

In the event of an incipient fire in subdistribution (2F), detector (1F) located in the subdistribution will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit. The central unit will then both give an alarm signal to an external warning system via the central unit's alarm output (6) and activate switching device (3D). The switching unit then breaks the current to the subdistribution and the part of the installation supplied therefrom in order to isolate the fault location before the fire develops.

In the event of an incipient fire in main distribution (2A), detector (1A) located in the intake box will detect gas/smoke/heat that is generated and give a pre-warning signal to the central unit (4) when the concentration of gas/smoke/heat exceeds a pre-set pre-warning level. The central unit then gives a pre-warning signal to external warning systems via the central unit's alarm output (6) which gives the owner/user the opportunity to inspect the fault location and repair the fault before the current is broken, or, for example, to be able to conduct a controlled run down of sensitive equipment before current is broken. When the concentration of gas/smoke/heat exceeds a pre-set alarm level (higher than the pre-warning level), the detector will give an alarm signal to the central unit.

The central unit will then both give an alarm signal to an external warning system via the central unit's alarm output (6) and activate switching device (3A). The switching device then breaks the current to the whole installation in order to isolate the fault location before the fire develops.

When the EFP system has shut down a fuse box, an electrician or operation manager can turn on power in the fuse box in question and wait for about 10 minutes so that the temperature at the fault location rise again. He can subsequently take a thermal image of the fuse box to find the fault location. The fault location can then be repaired quickly with a brief shutdown as none of the equipment has been destroyed as a consequence of the incipient fire (for example, chlorine gas contamination).

Advantages of the EFP System

- A substantial proportion of all fires start in the fuse box (including subdistributions and intake boxes). This system is the only product on the market that prevents such fires before they develop.
- The system detects an incipient fire at an early stage.
- The equipment in the fuse box is not destroyed and can be reused after the fault that led to the incipient fire has been repaired.
- Short shut-down in the event of an incipient fire—no need to replace the whole fuse box.
- With small adjustments, the product is suitable for all types of buildings and facilities, including dwellings, mountain cabins, farms, public buildings/offices and industrial plants.
- There are no other known systems today that function is a similar manner. Today's systems function in that the fire must have broken out before necessary measures are taken ($CO_2$ emission, sprinkler system etc.)*
- The system can be connected to external warning systems (for example, alarm systems and number transmitters) which can give the owners and others warning of tripped protection.
- The problems of fire in fuse boxes located in escape routes (where fuse boxes are located in stairwells as in apartment blocks, office blocks etc). are avoided.
- When installed in new facilities, the system will prevent fire resulting from faulty wiring/human error (inadequately tightened connecting terminal on bottom connections etc.)
- The detectors used in the system are patented, environment-friendly ionic detectors (contain 1/10 of the radioactivity of competing ionic detectors). The detectors are therefore not considered special waste when they are scrapped.

The invention claimed is:

1. A system for detecting and preventing an electrical fire in a domestic electricity distribution system comprising an intake fuse box, a main distribution panel comprised in a main panel housing, a subdistribution panel comprised in a subpanel housing, a main power circuit connecting the intake fuse box to the main distribution panel, and a sub power circuit connecting the main distribution panel to the subdistribution panel, characterised in that the system comprises a) first, second and third gas, smoke and heat detectors arranged in respective ones of said intake fuse box, said main panel housing, and said subpanel housing, said first, second and third gas, smoke and heat detectors being adapted to provide respective first, second and third low level outputs if subjected to a gas, smoke or heat exceeding a first threshold and to provide respective first, second and third high level outputs if subjected to a gas, smoke or heat exceeding a second threshold, b) a remote controlled main level circuit breaker arranged in the main power circuit, c) a remote controlled sub level circuit breaker arranged in the sub power circuit, and d) a controller unit having first, second and third inputs connected to respective ones of said first, second and third gas, smoke and heat detectors for receiving respective ones of said first, second and third low and high level outputs, an alarm output, and first and second breaker control outputs connected to respective ones of said main level and sub level circuit breakers.

2. The system of claim 1, characterised in that the controller unit is arranged to provide an alarm signal on the alarm output when receiving at least one of said first, second and third low level outputs or said first, second and third low high outputs.

3. The system of claim 2, characterised in that the controller unit is arranged to provide a main level circuit breaker trip signal on the first breaker control output when receiving said first or second high level inputs.

4. The system of claim 3, characterised in that the controller unit is arranged to provide a sub level circuit breaker trip signal on the second breaker control output when receiving said third high level input.

* * * * *